United States Patent [19]

Rosenthal et al.

[11] 4,330,390

[45] May 18, 1982

[54] TWO-STAGE COAL LIQUEFACTION PROCESS WITH PETROLEUM-DERIVED COAL SOLVENTS

[75] Inventors: Joel W. Rosenthal, El Cerrito; Arthur J. Dahlberg, Pinole, both of Calif.

[73] Assignee: Chevron Research Company, San Francisco, Calif.

[21] Appl. No.: 12,185

[22] Filed: Feb. 14, 1979

Related U.S. Application Data

[63] Continuation-in-part of Ser. No. 754,198, Dec. 27, 1976.

[51] Int. Cl.[3] ..... C10G 1/06; C10G 1/00

[52] U.S. Cl. ..... 208/10; 208/8 LE

[58] Field of Search ..... 252/10, 8 LE

[56] References Cited

U.S. PATENT DOCUMENTS

| | | | |
|---|---|---|---|
| 3,705,092 | 12/1972 | Gatsis | 208/8 |
| 3,840,456 | 10/1974 | Yavorsky et al. | 208/10 |
| 3,925,188 | 12/1975 | Lester | 208/8 |
| 3,966,584 | 6/1976 | Gray et al. | 208/131 X |
| 4,018,663 | 4/1977 | Karr | 208/10 |
| 4,052,291 | 10/1977 | Espensheid et al. | 208/8 |
| 4,054,504 | 10/1977 | Chervenak et al. | 208/10 |
| 4,110,192 | 8/1978 | Hildebrand et al. | 208/8 |
| 4,111,788 | 9/1978 | Chervenak et al. | 208/10 |

OTHER PUBLICATIONS

Chevron Research Co., Richmond Ca., Trip Report, Dahlberg, Jan. 8, 1975, to U.S. Bureau of Mine, Bruceton, Pa.

"Hydrocracking Athabasca Bitumen in the Presence of Coal Part 1: A Preliminary Study of the Changes Occurring in the Coal", M. Ternan et al., Department of Energy, Mines & Resources, Mines Branch, Ottawa, Research Report R-276, dated Oct. 1974.

"Hydrocracking of Athabasca Bitumen: Effect of Coal-Base Catalyst on Pilot Plant Operation", C. P. Khulbe et al., Canmet Report 77-35, Energy Mines & Resources Canada, dated Jan. 1977.

"A Comparative Study of Fe Catalysts, $ZnCl_2$ Catalysts and $ZNCl_2$-Promoted Fe Catalysts for Hydrocracking of Athabasca Bitumen", W. A. O. Herrmann et al., Canmet Report 77-50, Energy, Mines & Resources Canada, dated Jan. 1977.

*Primary Examiner*—Delbert E. Gantz
*Assistant Examiner*—William G. Wright
*Attorney, Agent, or Firm*—Dix A. Newell; Ronald H. Evans; Allen H. Uzzell

[57] ABSTRACT

An improved coal liquefaction process is disclosed wherein subdivided coal is substantially dissolved in a petroleum-derived solvent in the presence of added hydrogen in a non-catalytic dissolving stage at a temperature in the range 400°-480° C., thereby forming a mixture of dissolved coal, solvent and insoluble solids. The effluent mixture of solvent, dissolved coal and insoluble solids from the dissolver is contacted with a hydrocracking catalyst under hydrocracking conditions at a reduced temperature below 425° C., resulting in a product having a normally liquid portion which may be used directly as a low-sulfur, low-nitrogen fuel oil.

30 Claims, 1 Drawing Figure

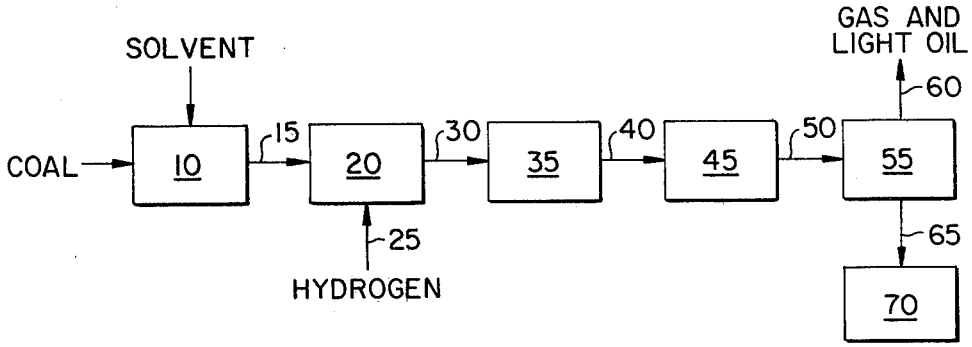
SOLVENT
COAL
10
15
20
25
HYDROGEN
30
35
40
45
50
55
GAS AND
LIGHT OIL
60
65
70

TWO-STAGE COAL LIQUEFACTION PROCESS WITH PETROLEUM-DERIVED COAL SOLVENTS

RELATED APPLICATION

This application is a continuation-in-part of application Ser. No. 754,198, filed Dec. 27, 1976, the disclosure of which is incorporated herein by reference.

BACKGROUND OF THE INVENTION

1. Field of the Invention

The present invention relates to an improved process for the liquefaction of raw subdivided coal. More particularly, the invention relates to an improved liquefaction process wherein the coal is dissolved in a petroleum-derived solvent at an elevated temperature and hydrocracked at a lower temperature to produce acceptable fuel oils accompanied by minimum gas production.

2. Prior Art

Coal is our most abundant indigenous fossil fuel resource, and as a result of dwindling petroleum reserves, concerted research efforts are being directed towards recovery of liquid hydrocarbons from coal on a commercial scale. A promising approach in this field relates to the direct liquefaction of coal accompanied with minimum gas production. This approach has principally evolved from the early work of F. Bergius, who discovered that transportation fuels could be produced by the high-pressure hydrogenation of a paste of coal, solvent and catalyst. Later discoveries revealed the advantageous use of specific hydrogenation solvents at lower temperatures and pressures. With these solvents, such as partially saturated polycyclic aromatics, hydrogen is transferred from the solvent to the coal molecules, thus causing depolymerization and dissolution of the coal. The resulting coal liquid, however, has a high molecular weight and an accordingly high viscosity, which presents considerable obstacles to removing the fine coal residue remaining in the liquid, since these particles typically range in size from 1 to 25 microns in diameter. The complete nature of the coal residue, or undissolved solids, is not wholly understood; however, the residue appears to be a composite of organic and inorganic species. The residue organic matter is similar to coke, and the residue inorganic matter is representative of the well-known ash constituents. Removal of the residue from the coal liquid has been considered a critical step in the prior art in the preparation of clean fuels, particularly in those processes in which the coal liquids are subjected to catalytic upgrading, such as hydrocracking.

Nearly all crude petroleum stocks and especially crude residua contain metal compounds, but the amounts and types of metals may vary considerably depending upon the geographic and geological origin of the coal. Certain South America crudes, for example, contain large amounts of vanadium but only small amounts of other metals. Other crudes, for example Middle Eastern, contain a broad spectrum of metals in only moderate concentrations, mostly metals such as nickel and vanadium, and smaller amounts of such metals as iron and sodium. Still other crudes, for example California crudes, contain large amounts of many metals, including large amounts of iron and sodium. In the processing of petroleum feedstocks over fixed-bed hydrocracking catalysts to convert the higher-boiling fractions to lower-boiling fractions, it is generally recognized that a high metals content in the feed tends to rapidly foul the catalyst bed. The metal compounds present in the residua will form metalliferous deposits on and between catalysts in the bed and within the pores of the catalyst. The deposits on and between the catalyst particles may clog the catalyst bed, thereby restricting the oil throughput. Deposits within the catalyst pores result in an over-all deactivation of the catalyst. It is therefore an object of this invention to provide a process for the liquefaction of coal with a petroleum feedstock having a relatively high metals content whereby the liquefaction products may be directly hydrocracked without substantial fouling of the catalyst bed.

SUMMARY OF THE INVENTION

In accordance with the present invention, there is provided a process for the liquefaction of coal wherein subdivided coal is substantially dissolved in a petroleum-derived solvent at a temperature between 400°–480° C., thereby forming a mixture comprising solvent, dissolved coal, and insoluble solids. The mixture of solvent, coal and insoluble solids is cooled to a temperature below 425° C., and lower than the temperature at which the coal is dissolved, and contacted in a reaction zone with hydrogen in the presence of an externally supplied hydrocracking catalyst under hydrocracking conditions. The normally liquid portion of the hydrocracked effluent stream has a specific gravity less than 1, a low sulfur and nitrogen content and a low metals content.

Further in accordance with the present invention, the coal is dissolved in the presence of added hydrogen at a pressure above 35 atm. The weight ratio of petroleum-derived solvent to coal is normally maintained in the range 5:1 to 0.5:1 and said petroleum solvent comprises a crude fraction boiling above 200° C.

The hydrocracking reaction zone may comprise a fixed bed, moving bed or ebullating bed of catalyst. The hydrocracking catalyst will preferably comprise a Group VIII and/or Group VI-B metal on a cracking support.

BRIEF DESCRIPTION OF THE DRAWING

The drawing is a block flow diagram of suitable flow paths for use in practicing one embodiment of the present invention.

DETAILED DESCRIPTION OF THE PREFERRED EMBODIMENTS

In a preferred embodiment, comminuted coal is slurried with a petroleum-derived solvent boiling above 200° C. in a mixing zone 10. The effluent slurry from zone 10 passes to a dissolver 20, wherein the slurry is heated to dissolve at least 50 weight percent of the coal in the presence of added hydrogen, thereby forming a mixture of solvent, dissolved coal and coal residue. The mixture from dissolver 20 is cooled in zone 35 to a temperature lower than the temperature of the dissolver and at least below 425° C. The cooled mixture is then hydrocracked in zone 40 to produce a relatively low-viscosity liquid product which may be readily separated from any remaining coal residue.

Referring to the drawing in detail, subdivided coal is mixed with a petroleum solvent in mixing zone 10. The basic feedstock for the present invention is a solid subdivided coal such as anthracite, bituminous coal, subbituminous coal, lignite, or mixtures thereof. The bituminous and subbituminous coals are particularly preferred, and it is also preferred that said coals be ground to a particle size smaller than 100 mesh, Tyler Standard Sieve Size, although large coal sizes may be processed. The solvent will typically comprise partially hydrogenated polycyclic aromatic hydrocarbons, generally one or more rings at least partially saturated. Examples of such materials are tetrahydronaphthalene, dihydronaphthalene, dihydroanthracene, and similar materials. Such solvents may be obtained from numerous materials, but it is particularly preferred to use a 200° C. or higher-boiling petroleum fraction, such as a topped naphthenic crude or a vacuum residua. Asphaltic or naphthenic crudes are generally higher in aromatics and naphthenes in comparison to paraffinic base crudes. As a result, such crudes are preferable over the paraffinic crudes for use as solvents in the present invention. Such crudes are also usually higher in sulfur, nitrogen and metals than paraffinic crudes and thus greater problems in refining processes than said crudes. The process of the present invention, however, is capable of tolerating the higher metals content in the hydrocracking zone without prior demetallation or pretreatment precautions. It is believed that a substantial portion of the metals of the crude are bound to or deposit upon the coal residue suspended in the liquid and thus do not tend to deposit on the cracking catalyst.

The subdivided coal is mixed with the solvent in a solvent-to-coal weight ratio from about 0.5:1 to 5:1, and preferably from about 1:1 to 2:1. From mixing zone 10, the slurry is fed or pumped through line 15 to a dissolving zone 20, wherein the slurry is heated, preferably in the presence of added hydrogen, to a temperature in the range of 400° C. to 480° C., preferably 425° C. to 455° C., for a length of time sufficient to substantially dissolve the coal. At least 50 weight percent, and preferably greater than 90 weight percent of the coal, on a moisture- and ash-free basis, is dissolved in zone 20, thereby forming a mixture of solvent, dissolved coal and insoluble solids, or coal residue. It is usually necessary that the slurry be heated to at least 400° C. to obtain a 50% dissolution of the coal. Further, it is usually required that the coal slurry not be heated to temperatures above 480° C. to prevent thermal cracking, which substantially reduces the over-all yield of normally liquid products.

Hydrogen is also introduced into the dissolving zone through line 25 and normally comprises fresh hydrogen and recycle gas. Other reaction conditions in the dissolving zone include a residence time of 0.01 to 3 hours, preferably 0.1 to 1 hour; a pressure in the range of 35 to 680 atmospheres, preferably 100 to 340 atmospheres, and more preferably 100 to 200 atmospheres; and a hydrogen gas rate of 355 to 3550 liters per liter of slurry and preferably 380 to 1780 liters per liter of slurry. The physical structuring of the dissolving zone is such that the slurry may flow upwardly or downwardly in said zone. Preferably the zone is sufficiently elongated to attain plug-flow conditions, which permits the process of the present invention to be practiced on a continuous basis.

The dissolving zone contains no catalyst from any external source, although the mineral matter contained in the coal may have some catalytic effect. The mixture of solvent, dissolved coal and insoluble solids from dissolver 20 passes via line 30 to cooling zone 35. Cooling zone 35 will typically contain a heat exchanger or similar means whereby the effluent from dissolver 20 is cooled to a temperature below the temperature of the dissolving stage and at least below 425° C. Some cooling in zone 35 may also be effected by the addition of fresh cold hydrogen, if desired. The cooled mixture of solvent, dissolved coal, insoluble solids and hydrogen is fed through line 40 into reaction zone 45 containing a hydrocracking catalyst. In the hydrocracking reaction zone, hydrogenation and cracking occur simultaneously and the higher-molecular-weight compounds are converted to lower-molecular-weight compounds, the sulfur compounds are converted to hydrogen sulfide, the nitrogen compounds are converted to ammonia, and the oxygen compounds are converted to water. Preferably the catalytic reaction zone is a fixed-bed type, but an ebullating or moving bed may also be used. The mixture of gases, liquids and insoluble solids preferably passes upwardly through the catalytic reaction zone, but may also pass downwardly.

The catalyst used in the hydrocracking zone may be any of the well-known commercially available hydrocracking catalysts. A suitable catalyst for use in the hydrocracking reaction stage comprises a hydrogenation component and a cracking component. Preferably the hydrogenation component is supported on a refractory cracking base. Suitable bases include, for example, silica, alumina, or composites of two or more refractory oxides such as silica-alumina, silica-magnesia, silica-zirconia, alumina-boria, silica-titania, silica-zirconia-titania, acid-treated clays, and the like. Acidic metal phosphates such as alumina phosphate may also be used. Preferred cracking bases comprise alumina and composites of silica and alumina. Suitable hydrogenation components are selected from Group VI-B metals, Group VIII metals, and their oxides, or mixtures thereof. Particularly useful are cobalt-molybdenum, nickel-molybdenum, or nickel-tungsten on silica-alumina supports.

It is preferred to maintain the temperature in the hydrocracking zone below 425° C., preferably in the range 340° C. to 425° C., and more preferably 340° C. to 400° C., to prevent catalyst fouling. The temperature in the hydrocracking zone should be preferably maintained below the temperature in the dissolving zone by 55° to 85° C. Other hydrocracking conditions include a pressure from 35 atmospheres to 680 atmospheres, preferably 70 atmospheres to 200 atmospheres; a hydrogen rate of 355 to 3550 liters per liter of slurry, preferably 380 to 1780 liters per liter of slurry; and a slurry-liquid hourly space velocity in the range 0.1 to 2, preferably 0.2 to 0.5.

Preferably the pressures in the noncatalytic dissolving stage and the catalytic hydrocracking stage are maintained substantially equal.

Preferably the entire effluent from the dissolver is passed to the hydrocracking zone. However, since small quantities of water and light gases ($C_1$–$C_4$) are produced in the dissolver, the catalyst in the second stage is subjected to a lower hydrogen partial pressure than if these materials were absent. Since higher hydrogen partial pressures tend to increase catalyst life, it may be desired in a commercial operation to remove a portion of the water and light gases before the stream enters the hydrocracking stage. Furthermore, interstage removal of the carbon monoxide and other oxygen-containing gases may reduce the hydrogen consumption in the hydrocracking stage due to reduction of the carbon oxides. The product effluent 50 from reaction zone 45 may be separated into a gaseous fraction 60 and a solids-liquid fraction 65 in zone 55. The gaseous fraction comprises light oils boiling below about 65° C. to 130° C. and normally gaseous components such as hydrogen, carbon monoxide, carbon dioxide, water and the $C_1$–$C_4$ hydrocarbons. Preferably the hydrogen is separated from the other gaseous components and recycled to the hydrocracking or dissolving stages. The liquid-solids fraction 65 may be fed to solids separation zone 70 wherein the insoluble solids are separated from the liquid by conventional means, for example hydroclones, filters, centrifugal separators, cokers and gravity settlers, or any combination of said means in zone 70.

The process of the present invention produces extremely clean, normally liquid products. The normally liquid products, that is, all of the product fractions boiling above $C_4$, have an unusually low specific gravity; a low sulfur content of less than 0.2 weight percent; and a low nitrogen content, less than 0.5 weight percent. The advantages of the present invention will be readily apparent from consideration of the following examples.

EXAMPLE

A slurry consisting of 33 weight percent River King coal and 67 weight percent topped Kern River crude was passed sequentially through a first stage dissolving zone and a second stage hydrocracking zone in the presence of added hydrogen. The coal was ground to a particle size of 100- mesh (Tyler standard sieve) and had the following analysis on a weight percent dry basis: carbon, 59%; hydrogen, 4.14%; nitrogen, 1.14%; oxygen 11.03%; sulfur, 4.36%; ash, 20.33%. The crude solvent comprised a 200° C.+ fraction having the following characteristics: specific gravity, 0.977; saturates, 37.3 weight percent; aromatics, 59.2 weight percent; sulfur compounds, 3.5 weight percent; metals: nickel, 67 ppm; vanadium, 33 ppm; iron, 27 ppm; a thermal gravimetric analysis (TGA) is given below for comparison with the $C_4$+ product effluent. Hydrogen was introduced into the dissolver at a rate of 1780 $m^3$ of slurry. The slurry had a residence time of approximately one hour in the dissolver which was maintained at a pressure of 163 atmospheres and a temperature of 455° C. The effluent mixture of gases, liquids and solids was passed to the second stage which was maintained at 163 atmospheres and 400° C. The second stage contained a fixed bed of hydrocracking catalyst comprising 10 weight percent nickel and 24 weight percent tungsten on an alumina base. A space velocity in the hydrocracking stage was maintained at 0.38/hour based upon the feed slurry and a hydrogen consumption rate of 349 cubic meters per cubic meter of $C_4$+ product was observed. The hydrocracker effluent had the following properties:

| Product Distribution | Weight Percent |
|---|---|
| $C_1$–$C_3$ | 5.4 |
| $C_4$+ liquid | 86.8 |
| Unreacted coal | 2.8 |
| $H_2S$, $NH_3$, $H_2O$, $CO_x$ | 7.7 |

The $C_4$+ liquid product had a specific gravity of 0.898, a sulfur content of 0.02 weight percent and a nitrogen content of 0.23 weight percent. Thermal gravimetric analyses of a $C_4$+ liquid are shown immediately following in comparison to the thermal gravimetric analysis of the Kern River crude.

| Fraction | Liquid Product Effluent | Kern River Crude |
|---|---|---|
| $C_4$-200° C. | 18.7 | — |
| 200°–345° C. | 46.2 | 16.4 |
| 345°–540° C. | 30.5 | 45.0 |
| 540° C.+ | 4.5 | 38.0 |

What is claimed is:

1. A process for liquefying coal, which comprises:

(a) forming a coal-solvent slurry by mixing subdivided coal with a petroleum fraction boiling above 200° C.;

(b) substantially dissolving said coal in said fraction by heating said slurry to a temperature between 400° C. and 480° C. in the presence of hydrogen, thereby forming a mixture comprising dissolved coal, the petroleum fraction, and insoluble solids;

(c) contacting said mixture in a reaction zone with hydrogen and an externally supplied hydrocracking catalyst under hydrocracking conditions, including a temperature 55° to 85° C. lower than the temperature to which said slurry is heated in the dissolving step; and (d) withdrawing from said reaction zone an effluent stream, the normally liquid portion of which has a specific gravity less than 1.0.

2. A process as recited in claim 1, wherein said coal is dissolved in the presence of added hydrogen at a pressure above 35 atmospheres.

3. A process as recited in claim 1, wherein the normally liquid portion of said effluent stream has a sulfur content less than 0.2 weight percent and a nitrogen content of less than 0.5 weight percent.

4. A process as recited in claim 1, wherein said slurry is heated to a temperature between 425° and 455° C. in the dissolving step, and said hydrocracking is conducted at a temperature in the range 345° to 400° C. and a pressure in the range 70 to 680 atmospheres.

5. A process as recited in claim 1, wherein the weight ratio of the petroleum fraction to coal in said slurry is in the range 5:1 to 0.5:1.

6. A process as recited in claim 1, wherein said petroleum fraction comprises an asphaltic crude fraction.

7. A process as recited in claim 1, wherein said petroleum fraction contains metal contaminants.

8. A process as recited in claim 1, wherein the hydrocracking catalyst is maintained as a fixed bed.

9. A process as recited in claim 1 wherein said hydrocracking catalyst comprises at least one hydrogenation component selected from Group VI-B or Group VIII supported on an alumina support.

10. A process as recited in claim 1 wherein said hydrocracking conditions include a temperature of 340° to 425° C., a pressure of 70 to 200 atmospheres, and a slurry-liquid hourly space velocity in the range of 0.1 to 2.

11. A process as recited in claim 1, 7, or 10 wherein said step (c) comprises passing said mixture upwardly through a fixed bed comprising said hydrocracking catalyst.

12. A process as recited in claim 1, 7, or 10 wherein said step (c) comprises passing said mixture upwardly through a moving bed comprising said hydrocracking catalyst.

13. A process as recited in claim 1, 7 or 10 wherein said step (c) comprises passing said mixture upwardly through an ebullating bed comprising said hydrocracking catalyst.

14. A process for liquefying coal, which comprises:
(a) forming a coal-solvent slurry by mixing subdivided coal with a petroleum-derived solvent containing metal contaminants;
(b) substantially dissolving said coal in said solvent by heating said slurry to a temperature between 400° C. and 480° C. in the presence of hydrogen, thereby forming a mixture comprising solvent, dissolved coal, and insoluble solids;
(c) passing at least a portion of said mixture containing said insoluble solids into a reaction zone and contacting said portion with hydrogen and an externally supplied hydrocracking catalyst under hydrocracking conditions, including a temperature lower than the temperature to which the slurry is heated in the dissolving step; and
(d) withdrawing from said reaction zone an effluent stream.

15. A process as recited in claim 14 wherein the normally liquid portion of said effluent stream has a specific gravity less than 1.0, a sulfur content less than 0.2 weight percent, and a nitrogen content of less than 0.5 weight percent.

16. A process as recited in claim 14 wherein said solvent is crude petroleum.

17. A process as recited in claim 14 wherein said solvent comprises an asphaltic crude fraction boiling above 200° C.

18. A process as recited in claim 14 wherein the reaction zone temperature is 55° to 85° C. lower than the temperature to which said slurry is heated in the dissolving step.

19. A process as recited in claim 14 wherein the hydrocracking catalyst is maintained as a fixed bed.

20. A process as recited in claim 14 wherein said hydrocracking catalyst comprises at least one hydrogenation component selected from Group VI-B or Group VIII supported on an alumina support.

21. A process as recited in claim 14 wherein said hydrocracking conditions include a temperature of 340° to 425° C., a pressure of 70 to 200 atmospheres, and a slurry-liquid hourly space velocity in the range of 0.1 to 2.

22. A process as recited in claim 14 or 21 wherein said step (c) comprises passing said portion of said mixture containing said insoluble solids upwardly through a fixed bed comprising said hydrocracking catalyst.

23. A process as recited in claim 14 or 21 wherein said step (c) comprises passing said portion of said mixture containing said insoluble solids upwardly through a moving bed comprising said hydrocracking catalyst.

24. A process as recited in claim 14 or 21 wherein said step (c) comprises passing said portion of said mixture containing said insoluble solids upwardly through an ebullating bed comprising said hydrocracking catalyst.

25. A process for liquefying coal, which comprises:
(a) forming a coal-solvent slurry by mixing subdivided coal with a petroleum-derived solvent;
(b) substantially dissolving said coal in said solvent by heating said slurry to a temperature between 400° and 480° C. in the presence of hydrogen, thereby forming a mixture comprising solvent, dissolved coal, and insoluble solids;
(c) passing at least a portion of said mixture containing said insoluble solids into a reaction zone and contacting said portion with hydrogen and a fixed bed of externally supplied hydrocracking catalyst under hydrocracking conditions, including a temperature lower than the temperature to which the slurry is heated in the dissolving stage; and
(d) withdrawing from said reaction zone an effluent stream.

26. A process as recited in claim 25 wherein the normally liquid portion of said effluent stream has a specific gravity less than 1.0, a sulfur content of less than 0.2 weight percent, and a nitrogen content of less than 0.5 weight percent.

27. A process as recited in claim 25 wherein the reaction zone temperature is 55° to 85° C. lower than the temperature to which said slurry is heated in the dissolving step.

28. A process as recited in claim 25 wherein said hydrocracking catalyst comprises at least one hydrogenation component selected from Group VI-B or Group VIII supported on an alumina support.

29. A process as recited in claim 25 wherein said hydrocracking conditions include a temperature of 340° to 425° C., a pressure of 70 to 200 atmospheres, and a slurry-liquid hourly space velocity in the range of 0.1 to 2.

30. A process as recited in claim 25 or 29 wherein said step (c) comprises passing said portion of said mixture containing said insoluble solids upwardly through said fixed bed comprising said hydrocracking catalyst.

* * * * *